US005170523A

United States Patent [19]

Scholl

[11] Patent Number: 5,170,523

[45] Date of Patent: Dec. 15, 1992

[54] METHOD AND APPARATUS FOR WET PROCESSING OF FABRIC

[75] Inventor: Marc D. Scholl, Elon College, N.C.

[73] Assignee: Scholl America, Inc., Graham, N.C.

[21] Appl. No.: 790,419

[22] Filed: Nov. 7, 1991

Related U.S. Application Data

[63] Continuation-in-part of Ser. No. 557,496, Jul. 24, 1990.

[51] Int. Cl.[5] ..... D06B 3/28

[52] U.S. Cl. ..... 8/152; 8/158; 68/178; 68/207

[58] Field of Search ..... 68/177, 178, 184, 207, 68/180, 181 R; 8/152, 158, 157

[56] References Cited

U.S. PATENT DOCUMENTS

| | | | |
|---|---|---|---|
| 2,471,506 | 5/1949 | Wiswall | 134/111 |
| 3,280,602 | 10/1966 | Schiffer | 68/207 X |
| 3,685,325 | 8/1972 | Carpenter | 68/207 X |
| 3,686,901 | 8/1972 | Vihl | 68/177 |
| 3,921,420 | 11/1975 | Aurich et al. | 68/178 X |
| 3,948,490 | 4/1976 | Troope | 8/158 |
| 4,016,733 | 4/1972 | Fleissner | 68/178 X |
| 4,036,038 | 7/1977 | Aurich et al. | 68/178 X |
| 4,357,811 | 11/1982 | Sando et al. | 68/207 X |
| 4,445,346 | 5/1984 | Witt | 68/178 |
| 4,829,620 | 5/1989 | Christ et al. | 8/152 X |
| 4,947,660 | 8/1990 | von der Eltz et al. | 68/177 X |
| 5,010,613 | 4/1991 | Driesen et al. | 8/158 |

*Primary Examiner*—Frankie L. Stinson

*Attorney, Agent, or Firm*—Ralph H. Dougherty

[57] ABSTRACT

Apparatus for wet processing fabric with fluid, which includes a primary container for containing and processing fabric, mechanism for partially flooding the primary container, and a counterflow recycling mechanism. The primary container includes a kier for wet processing fabric, a chamber disposed within the kier, for receiving fabric and fluid therein, the chamber having a plurality of perforation, wherein the mechanism for partially flooding the primary container includes a receptacle, disposed within the kier beneath the chamber, being positioned to collect fluid which passes through the perforations of the chamber. The receptacle is sized to surround the chamber so that the amount of fluid in the chamber is sufficient to permit the flow of fabric through the chamber and the amount of fluid in the kier outside the receptacle is sufficient to meet net pressure suction heat requirements of the pumping system employed by the apparatus. The counterflow recycling mechanism includes a plurality of ancillary containers for containing fluid and a mechanism for transferring fluid back and forth between the primary container and the ancillary containers. A method for wet processing fabric with fluid is also disclosed.

18 Claims, 4 Drawing Sheets

METHOD AND APPARATUS FOR WET PROCESSING OF FABRIC

CROSS REFERENCE TO RELATED APPLICATION

This application is a continuation-in-part of co-pending application Ser. No. 07/557,496 filed Jul. 24, 1990, now still pending.

BACKGROUND OF THE INVENTION

1. Field of the Invention

The present invention relates to wet processing of fabrics, and more particularly, to a method and apparatus for wet processing of fabric, such as bleaching, dyeing, and washing, which includes partial flooding and counterflow recycling.

2. Description of Related Art

Wet processing of fabric, such as bleaching, dyeing and washing, is typically accomplished either by a continuous process or by a batch process. Continuous processing normally includes a counterflow rinsing principle wherein fabric continuously moves through different chambers and rinse water simultaneously moves through the same chambers in the opposite direction of the fabric flow. Rolls positioned between each chamber ordinarily squeeze dry the fabric between chambers. Batch processing normally involves draining a bleaching batch, refilling the machine with rinse water, heating the rinse water to a certain temperature, and draining the rinse water, commonly referred to as a "fill and drain" process. The fill and drain process can be repeated several times at different rinsing temperatures. An alternative batch processing method, referred to as an "overflow rinse" process, involves continuously feeding fresh water, at a certain temperature, into a bleaching and dyeing chamber and continuously draining rinse water through an overflow pipe for a specified period of time.

In a jet or overflow dyeing machine, the ratio of the amount of liquor, or rinsing water, to the amount of fabric, or goods, is defined as the "liquor ratio". The liquor ratio can be lowered by increasing the amount of goods in the chamber and decreasing the liquor level in the jet or overflow dyeing machine. In a conventional chamber, lowering the liquor ratio can result in "crushing" or surface distortion of the fabric due to increased material load in the chamber. Poor fabric flow through the chamber may also occur as a result of the fabric laying too dry in the chamber at a low liquor level.

Continuous processing is disadvantageous due to the large volume of water which must be pumped through the system in order to provide for effective rinsing. For example, 4–10 gallons of water per pound of dry fabric is typically required for fabric which is 100% cotton. In addition, the quality of the fabric may be compromised in continuous processing due to the use of squeeze rolls between the chambers.

Batch processing also suffers from the disadvantage of requiring a large volume of water through the system. Batch processing also involves heating the water, thereby requiring the expenditure of energy. Of course, as more water is required to be heated, more energy is required to be expended.

Applicant is aware of the following U.S. patents concerning washing and/or dyeing methods and devices.

| U.S. Pat. No. | EXPIRES | INVENTOR | TITLE |
|---|---|---|---|
| 2,588,774 | 03-11-1969 | Smith | AUTOMATIC WASHING MACHINE |
| 3,170,314 | 02-23-1982 | Worst | WASHING SYSTEM FOR ECONOMIZING ON WATER USAGE |
| 3,686,762 | 08-29-1989 | Glaze | METHOD OF SHRINKING AND/OR DYEING KNIT GARMENTS |
| 3,841,116 | 10-15-1991 | Klein | MULTIPLE AUTOMATIC WASHER SYSTEM |
| 3,932,127 | 01-13-1993 | D'Albignac | DYEING TEXTILE MATERIALS OF A BASIC CHARACTER |
| 4,152,113 | 05-01-1996 | Walker | SYSTEM FOR DYEING HOSIERY GOODS |
| 4,020,658 | 05-03-1994 | Thies | APPARATUS FOR WET-TREATING FABRICS |
| 4,080,166 | 03-21-1995 | Müller | EMULSIFIERS FOR DYEING ACCELERATORS BASED ON ALKYNAPHHALENES |
| 4,483,032 | 11-20-2001 | Christ | PROCESS FOR TREATING TEXTILE MATERIAL IN JET DYEING MACHINES |

Walker discloses the saving and re-use of the liquids in a dyeing system, thereby avoiding direct dumping into municipal sewers. The dye bath, rinse waste water, and finish waste water are moved from tank to tank, heated or clarified as necessary, and reused in the dyeing process.

In Glaze, a dye solution is recirculated to a reservoir. A means of transferring the material to be dyed is also shown. D'Albignac pertains to recycling, generally, in dyeing processes.

The remaining patents relate to washing machines. In Smith, the rinse water is recirculated and/or added to the suds in the machine. Worst uses the same water for rinsing and washing, and in Klein the wash and rinse liquids are recirculated among and between the plural washing machines.

None of the related art appear to disclose the structure, operation, and result of the present invented apparatus, or the process of the invented method.

SUMMARY OF THE INVENTION

The apparatus for wet processing fabric includes a primary container for containing and processing fabric, a mechanism for partially flooding the primary container, and a counterflow recycling mechanism. The primary container includes a kier for wet processing fabric. A chamber is disposed within the kier and receives fabric and fluid therein. The chamber has a plurality of perforations. The mechanism for partially flooding the primary container includes a receptacle, disposed within the kier beneath the chamber, which is positioned to collect fluid which passes through the perforations of the chamber. The receptacle is sized to surround the chamber so that the amount of fluid in the chamber is sufficient to permit the flow of fabric through the chamber and the amount of fluid in the kier outside the receptacle is sufficient to meet net pressure suction head requirements of the pumping system employed by the apparatus. The counterflow recycling mechanism includes a plurality of ancillary containers for containing fluid and a mechanism for transferring fluid back and forth between the primary container and the ancillary containers.

The method for wet processing fabric includes providing a primary container and a plurality of ancillary containers. Each ancillary container is initially filled with fluid. Fluid is transferred from one of the ancillary containers to the primary container and fabric is concurrently circulated within the primary container. The fabric is then bleached in the primary container and the primary container is thereafter drained. For each of the remaining ancillary containers, fluid is transferred from one of the ancillary containers to the primary container, the fabric is either rinsed or neutralized using the partial flooding mechanism, and the fluid thereafter transferred from the primary container to one of the ancillary containers which contains no fluid. As a final rinse, the primary container is filled with fluid and the fabric is rinsed in the primary container. The fluid is then transferred from the primary container to one of the ancillary containers which contains no fluid. Finally, the fabric is unloaded from the primary container.

OBJECTS OF THE INVENTION

The principal object of the invention is to provide a method and apparatus for bleaching and dyeing fabric which minimizes water consumption.

A further object of this invention to provide a method and apparatus for bleaching and dyeing fabric which minimizes adverse effects on fabric quality.

A further object of this invention to provide a method and apparatus for bleaching and dyeing fabric which reduces energy consumption.

Another object of this invention to provide a method and apparatus for bleaching and dyeing fabric which will result in faster bleaching and dyeing processing.

A further object of this invention to provide a method and apparatus for bleaching and dyeing fabric which reduces the amount of manual labor heretofore required in connection with bleaching and dyeing.

BRIEF DESCRIPTION OF THE DRAWINGS

The foregoing and other objects will become more readily apparent by referring to the following detailed description and the appended drawings in which.

DETAILED DESCRIPTION

Figure 1:
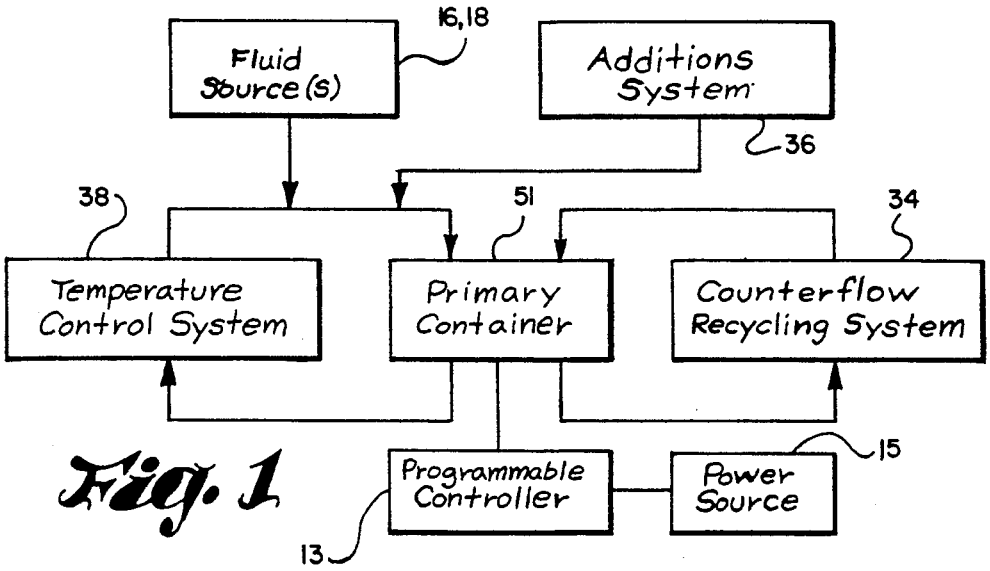
FIG. 1 is a diagram of the invented apparatus, illustrating the fluid source(s), counterflow recycling system, additions system, temperature control system, primary container, programmable controller, and power source.
Figure 3:
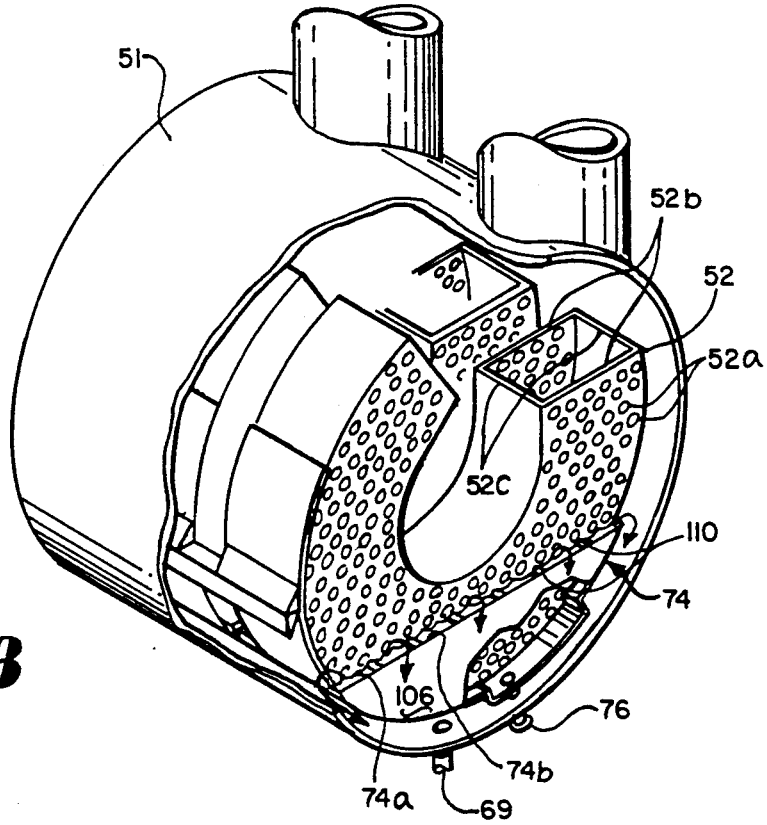
FIG. 3 is a perspective view of the primary container, with a portion broken away to illustrate the chamber and partial flooding device.
Figure 2:
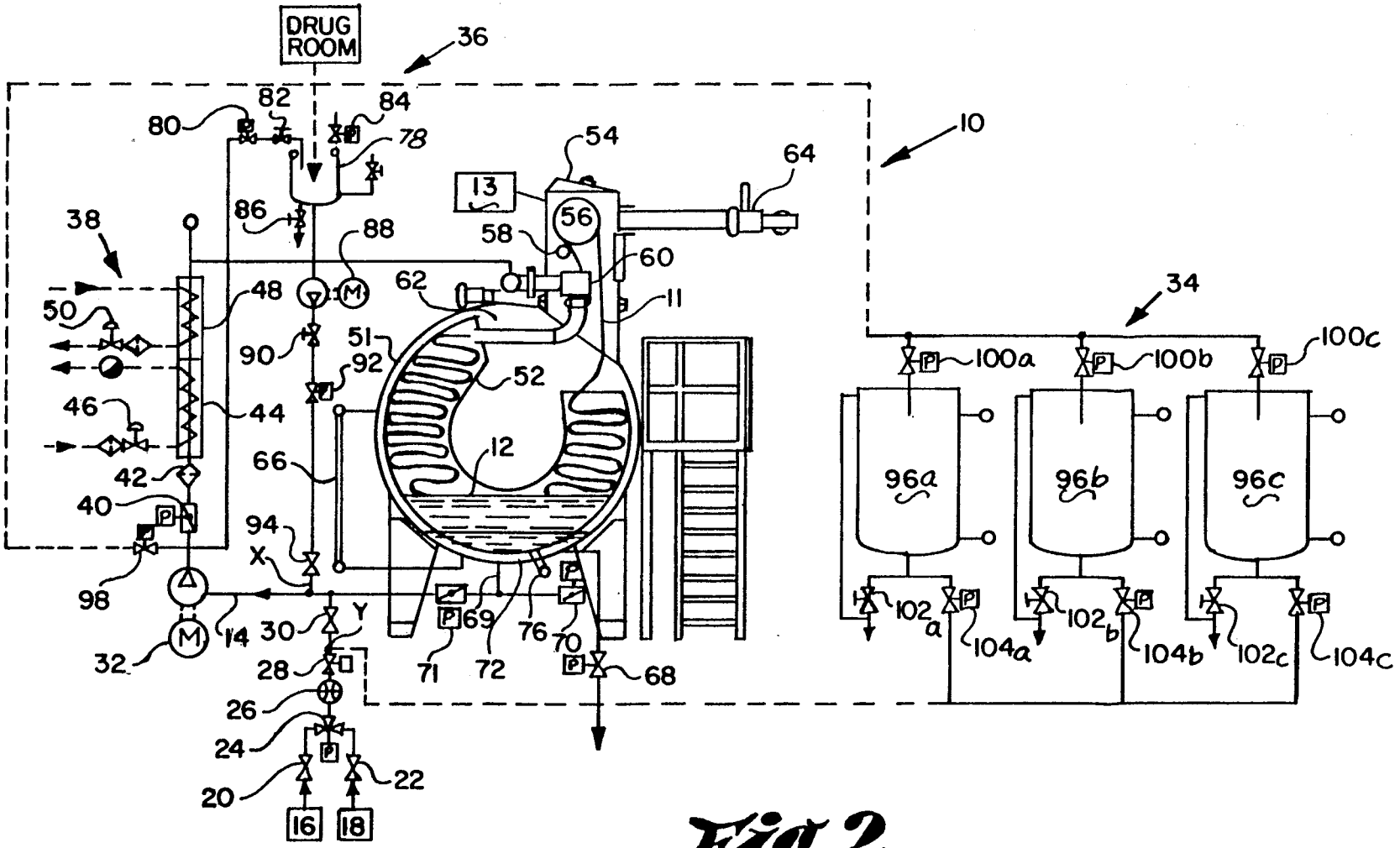
FIG. 2 is a diagram of the invented apparatus shown in FIG. 1, illustrating additional details concerning the fluid source(s), counterflow recycling system, additions system, temperature control system, and primary container.
Figure 4:
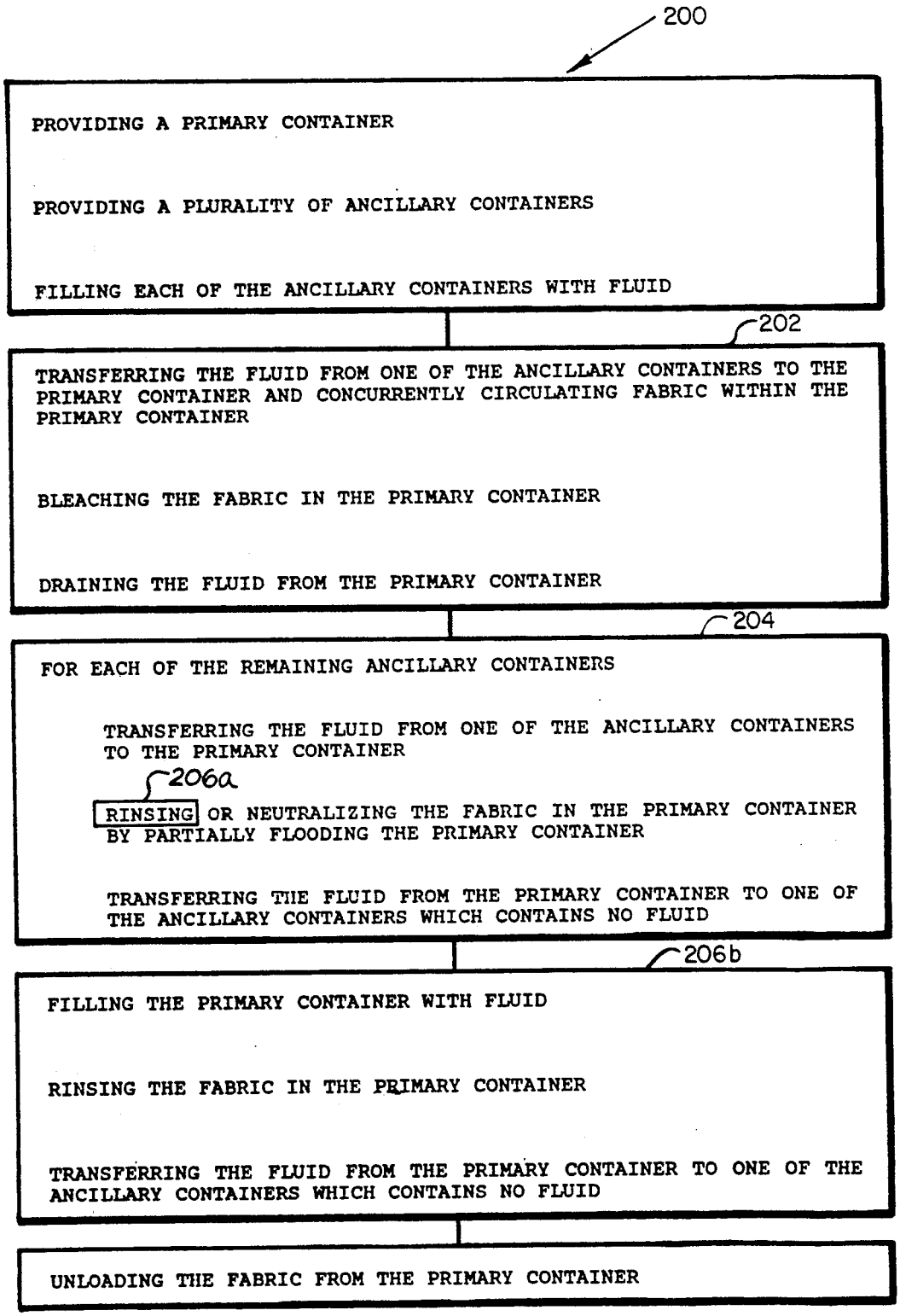
FIG. 4 is a flow diagram of the invented method for wet processing of fabric.
Figure 6:
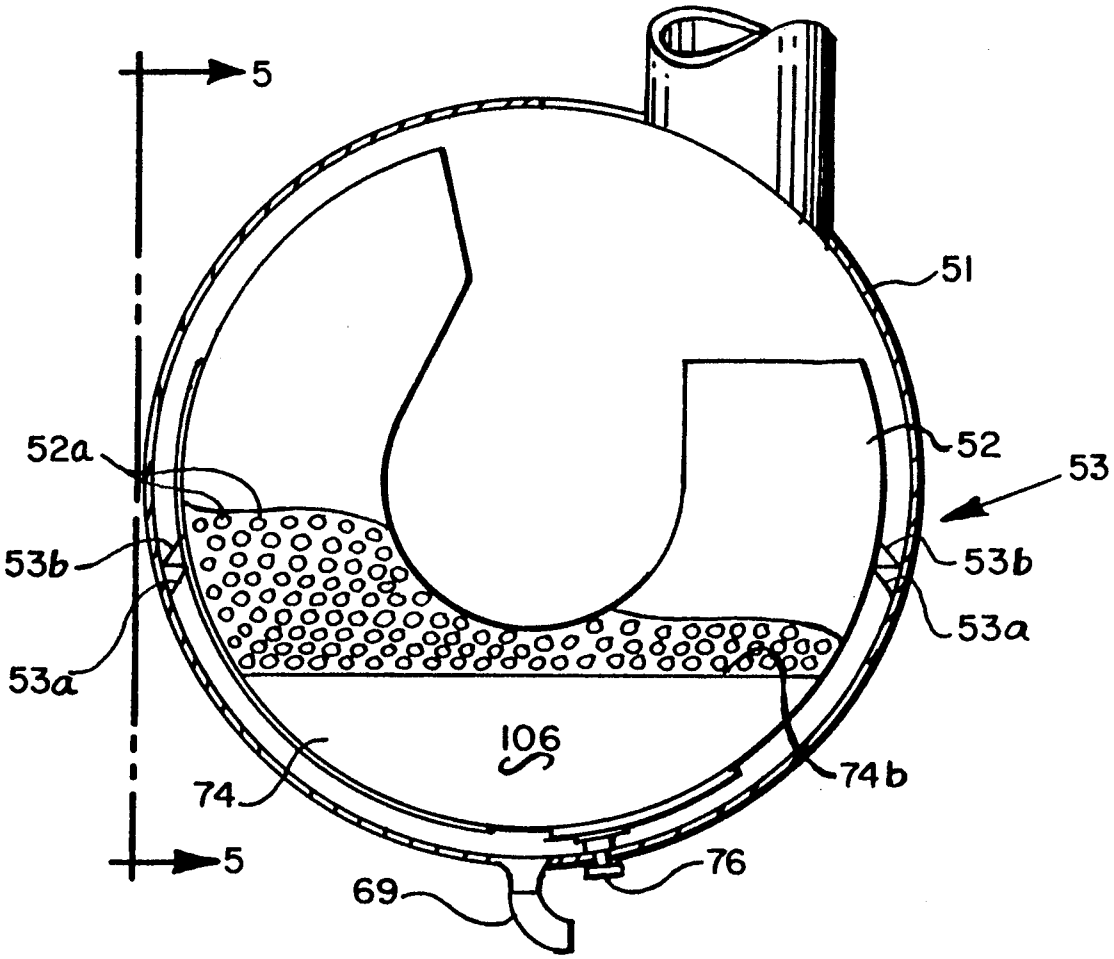
FIG. 6 is a sectional view of the primary container and partial flooding device, illustrating one end of the chamber.
Figure 5:
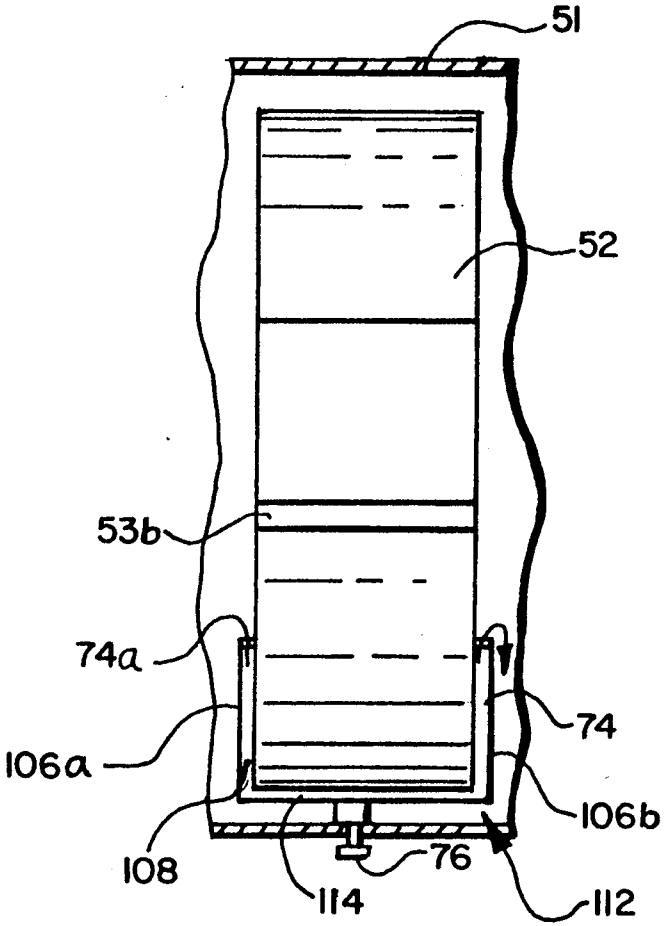
FIG. 5 is a sectional view of the primary container and partial flooding device, taken along line 5—5 of FIG. 6, illustrating a side view of the chamber with a portion of the kier removed.

Referring now to the drawings, and particularly to FIG. 1, the invented apparatus 10 for bleaching and dyeing fabric 11 is diagrammatically shown. Preferably the entire apparatus 10 is controlled by a programmable controller 13, which controls the opening and closing of valves, the operation of subsystems, and the timing of operations. As used herein, the term "programmable controller" means an electric or electronic device (e.g., a computer) for governing in some programmable and predetermined way the power delivered to an ancillary device. The apparatus 10 is powered by electric power from power source 15.

Fluid 12 is preferably supplied through a conduit 14 from two fluid sources 16, 18, controlled by fluid valves 20, 22, respectively, although a single fluid source may also be employed. The two fluid sources 16, 18 typically supply hot and cold water, respectively, or treated and untreated water, respectively. Fluid 12 from the two sources 16, 18 is combined through a blend fill 24, which is preferably a three-way pneumatically controlled valve. The blend fill 24 blends hot and cold water to a desired temperature from fluid sources 16 and 18. If the two fluid sources 16, 18 supply treated and untreated water, the blend fill 24 operates merely to select between the two sources. A flowmeter 26 controls the volume of fluid 12 supplied to the system. A pneumatically controlled fill valve 28 regulates the flow of fluid 12 into the system. A check valve 30 is positioned on the conduit 14 between the fill valve 28 and the kier 51. Fluid 12 is thereafter pumped through the system by a main pump 32. Fluid 12 is routed to a counterflow recycling system 34, to an additions system 36, or to a temperature control system 38, as required.

Fluid 12 routed through the temperature control system 38 first passes through an adjustable nozzle pressure control valve 40. Lint is then removed from the fluid 12 with a lint filter 42. The temperature of the fluid 12 is controlled by passing the fluid 12 through a heating element 44, controlled by a modulating heating valve 46, and through a cooling element 48, controlled by a modulating cooling valve 50. The temperature controlled fluid is then directed into a primary container which includes a chamber 52 contained within a kier 51. Preferably, the chamber 52 includes perforations **52*a*. The chamber, 52 is supported within the kier 51 by support mechanisms 53. Each support mechanism 53 includes a lower member 53*a* affixed to the interior wall of the kier 51, at approximately the horizontal centerline of the kier, and an upper member 53*b* which extends from the outer rounded wall of the chamber 52. An upper member 53*b* is adapted to rest on a lower member 53***a*, thus suspending the chamber 52 within the kier 51. Typically, upper and lower members are welded to one another. Fabric 11 is loaded into and unloaded from the chamber 52 by fabric supplying means 54 which includes main winch 56, a fabric running control device 58, a quick change venturi system 60, a plaiting system 62, and an unloading winch 64. Main winch 56 pulls the fabric 11 from a bin and into contact with fabric running control device 58 which feeds the fabric 11 into the quick change venturi system 60. Fluid 12 and fabric 11 are combined within the venturi system 60 and plaited into the chamber 52 by the plaiting system 62. The fluid content of the kier 51 is initially monitored by a level indicator 66 connected to the kier 51. The kier 51 includes means 68 for draining fluid from the kier. A pneumatically controlled overflow rinse valve 70 communicates with draining means 68. Means for recirculating fluid through the primary container includes a primary drain 69, located a the base of the kier 51, which is connected to conduit 14, and which serves as a transfer point for fluid 12 into and out of the kier 51, as regulated by transfer valve 71.

The kier 51 also contains means 72 for partially flooding the chamber. Partial flooding means 72 encapsulates the chamber 52. Partial flooding means 72 includes a receptacle 74 having a top opening 74*a* which includes a rim 74*b*. The receptacle 74 ensures that the fluid level inside the chamber 52 is high enough to avoid crushing and to provide for good fabric flow through the chamber 52, but allows the fluid level outside the receptacle 74 to drop to the minimum level for the net pressure suction head requirements of main pump 32. Processing fluid inside the chamber 52 exits through the perforations 52*a* of the chamber 52 into partial flooding means 72. Upon filling, the fluid flows over the top rim 74*b* of the receptacle 74 and cascades down to the kier fluid level outside the chamber 52, which leads to a substantial improvement of the overflow rinse process, because rinse fluid exiting the chamber will not come again in contact with the fabric and because of the continuous skimming effect which occurs at the top rim 74*b* of the receptacle 74. Partial flooding means 72 includes a drain valve 76 mounted on the bottom of the receptacle 74 in order to allow for draining and filling of the kier 51.

In the preferred embodiment, only the side walls 52*b* and the rounded interior chamber wall of the chamber 52 include perforations 52*a*. The rounded exterior chamber wall 52*c* is not perforated. In this preferred embodiment, partial flooding means 72 includes two generally semi-circular shaped stainless steel panels 106*a*, 106*b* which are mounted on the side walls 52*b* of the chamber 52, parallel to the side walls 52*b* of the chamber 52, at the bottom portion of the chamber 52. A panel 106 is mounted on a side wall 52*b* with a connector strip 108 which creates a space separating the panel 106 from the side wall 52*a*. Thus, two receptacles 74*a*, 74*b* are created whereby fluid 12 escaping from within the chamber 52 through the chamber perforations 52*a* is collected within the receptacles. Spacers 110 may also be positioned between the panel 106 and the side wall 52*a* to maintain the space between the two during fabric processing. In addition to the two receptacles 74*a*, 74*b* which are mounted to the side walls 52*a* of the chamber 52, a drain compartment 112 is also provided which connects one side receptacle to the other. The drain compartment 112 includes a pan-like stainless steel member 114 which mounts on the bottom of the chamber 52 and is affixed to and disposed beneath both side wall receptacles 74*a*, 74*b*. Thus, the drain compartment 112 defines a channel between, and serves as a common fluid collection point for, both side receptacles 74*a*, 74*b*. Drain valve 76 communicates with a hole within the drain compartment 112 and permits fluid to be drained from partial flooding means 72 into the kier 51. Typically, the panels 106*a*, 106*b*, connector strip 108, and pan-like member 114 are welded to the chamber 52.

Fluid 12 routed to the additions system 36 is added to an additional vessel 78, through a pre-additions pneumatic safety interlocking valve 80 and pre-additions manual valve 82. Selected additives are combined with the fluid. The required additives are transported to the vessel 78 from a drug room. The additional vessel 78 includes a manual drain valve 86 for draining the contents thereof as required. The combined fluid and additives are pumped back into the main system at point X along the conduit 14 by an additions pump 88, as regulated by a post-additions manual valve 90, a post-additions pneumatically controlled valve 92, and a post-additions check valve 94.

Fluid 12 routed to the counterflow recycling system 34 is directed to a plurality of ancillary containers 96, as regulated by a pneumatically controlled recycling valve 98. Each ancillary container 96 is provided with a pneumatically controlled inlet valve 100 for regulating the flow of fluid into the ancillary container, a manual drain valve 102 for regulating drainage from the ancillary container, and a pneumatically controlled outlet valve 104 for redirecting the contents of the ancillary container back into the main system. The contents of the ancillary containers are redirected back into the main system at point Y.

In operation, and assuming that the kier 51 and each of the ancillary containers 96 is empty, each ancillary container 96 is first filled with fluid 12, which is preferably clean water. Although the ancillary containers 96 may be filled directly from the fluid sources 16, 18, it is more typical to first fill the kier 51 and then transfer the fluid 12 from the kier 51 to an ancillary container 96, which results in less complicated programming requirements.

The basic steps involved in the invented process 200 include bleaching the fabric (step 202), neutralizing the fabric (step 204), and rinsing the fabric (steps 206*a*, 206*b*). The sequence and number of steps will vary according to the type of fabric 11, the number of ancillary containers 96 employed, and the preferences of the user. The process 200 will be explained by using an example in which three ancillary containers 96 are employed.

After filling each ancillary container 96 with clean water, the process 200 begins with a bleaching phase 202. The bleaching phase 202 includes transferring the fluid content of one of the ancillary containers 96 to the chamber 52, bleaching the fabric 11 in the chamber 52, and draining the fluid content from the chamber 52. In the example, the fluid content of ancillary container 96*a* is transferred to chamber 52 by opening pneumatically controlled outlet valve 104*a* and pumping the fluid content through conduit 14 and temperature control system 38 into the chamber 52. The transfer operation does not ordinarily include any temperature control. The objective is simply a rapid transfer.

Fabric 11 is loaded into the chamber 52 via fabric supplying means 54. Chemicals are added to the fluid 12 within the chamber 52 through the additions system 36. Various types of chemicals may be employed to bleach fabric, and the following references to specific chemicals is intended for illustrative purposes only. Typically a three stage additions cycle occurs. First, defoamerand wetting agents are introduced into the fluid 12 by mixing the agents in the additional vessel 78. The contents of the additions vessel 78 is then pumped back into the main system at point X by the additions pump 88. Second, a caustic agent and a sequestrian (for binding with iron) are added to the fluid 12 in order to adjust the pH factor and facilitate fiber breakup. The contents of the additions vessel 78 is then again pumped back into the main system at point X by the additions pump 88. Finally, peroxide is added with a stabilizer (for stabilizing peroxide) in order to provide the bleaching capability and the contents of the additions vessel 78 pumped back into the main system at point X by the additions pump 88. The bleaching fluid is circulated through the temperature control system 38, heated to a desired temperature, and maintained at the desired temperature for a desired period of time, thereby bleaching the fabric. Thereafter, the bleaching fluid is cooled to a desired temperature and drained from the chamber 52.

After the bleaching phase 202, the process continues with an initial rinsing phase 206*a*. The initial rinsing phase 206*a* includes transferring the fluid content of one of the ancillary containers 96 to the chamber 52, rinsing the fabric 11 in the chamber 52, and transferring the fluid content of the chamber 52 to one of the ancillary containers 96. In the example, the fluid content of ancillary container 96*b* is transferred to chamber 52 by opening pneumatically controlled outlet valve 104*b* and pumping the fluid content through conduit 14 and temperature control system 38 into the chamber 52. The rinsing fluid is circulated through the temperature control system 38, heated to a desired temperature, and maintained at the desired temperature for a desired period of time, thereby rinsing the fabric. The fluid content of chamber is then transferred to ancillary container 96*a* by opening pneumatically controlled transfer valve 98 and pumping the fluid content through conduit 14 and counterflow recycling system 34 into the ancillary container 96*a*.

The process continues with a neutralizing phase 204 after the initial rinsing phase 206*a*. The neutralizing phase 204 includes transferring the fluid content of one of the ancillary containers 96 to the chamber 52, neutralizing the fabric 11 in the chamber 52, and transferring the fluid content of the chamber 52 to one of the ancillary containers 96. In the example, the fluid content of ancillary container 96*c* is transferred to chamber 52 by opening pneumatically controlled outlet valve 104*c* and pumping the fluid content through conduit 14 and temperature control system 38 into the chamber 52. Acetic acid is added to the additional vessel 78 in order to provide the neutralizing capability and the contents of the additions vessel 78 pumped back into the main system at point X by the additions pump 88. The fluid content of chamber 52 is then transferred to ancillary container 96*b* by opening pneumatically controlled transfer valve 98 and pumping the fluid content through conduit 14 and counterflow recycling system 34 into the ancillary container 96*b*.

A final rinsing phase 206*b* typically follows the neutralizing phase 204. The final rinsing phase 206*b* includes transferring fluid 12 from one or both of the fluid sources 16, 18 to the chamber 52, and rinsing the fabric 11 in the chamber 52. After the final rinse, the fluid content of chamber 52 is then transferred to ancillary container 96*c* by opening pneumatically controlled transfer valve 98 and pumping the fluid content through conduit 14 and counterflow recycling system 34 into the ancillary container 96*c*. Fabric 11 is thereafter unloaded by fabric supplying means 54. Thus, at the conclusion of one process cycle, ancillary container 96*a* contains fluid which was used in the initial rinse phase 206*a*, ancillary container 96*b* contains fluid which was used in the neutralizing phase 204, and ancillary container 96*c* contains fluid which was used in the final rinse phase 206*b*. The system is therefore prepared for subsequent process cycles.

The three ancillary container example described above is summarized below in table form and includes preferred temperatures and timing characteristics.

| STEP | DESCRIPTION |
|---|---|
| 1 | Transfer 96a→chamber (160° F.) |
| 2 | Load fabric |
| 3 | Add agents: 1st: Defoamer, wetting agent 2nd: Caustic, sequestrian 3rd: Peroxide, stabilizer |
| 4 | Heat to 210° F. |
| 5 | Hold 30 min. |
| 6 | Cool to 180° F. |
| 7 | Drain |
| 8 | Transfer 96b→chamber (140° F.) |
| 9 | Heat to 170° F. |
| 10 | Hold 5 min (170° F.) |
| 11 | Transfer chamber→96a (170° F.) |
| 12 | Transfer 96c→chamber (92° F.) |
| 13 | Heat to 140° F. |
| 14 | Add Acetic Acid |
| 15 | Hold 5 min. (140° F.) |
| 16 | Transfer chamber→96b (140° F.) |
| 17 | Fill chamber (100° F.) |
| 18 | Hold 5 min. (100° F.) |
| 19 | Check pH and peroxide |
| 20 | Transfer chamber→96c (100° F.) |
| 21 | Unload |
| Total specific water usage: 5 l/kg (0.6 gal/lb) | |

SUMMARY OF THE ACHIEVEMENT OF THE OBJECTS OF THE INVENTION

From the foregoing, it is readily apparent that I have invented an improved method and apparatus for bleaching and dyeing, which minimizes adverse effects on fabric quality, reduces rinse water and energy consumption, increases processing capacity, and reduces the amount of manual labor heretofore required.

It is to be understood that the foregoing description and specific embodiments are merely illustrative of the best mode of the invention and the principles thereof, and that various modifications and additions may be made to the method and apparatus by those skilled in the art, without departing from the spirit and scope of this invention, which is therefore understood to be limited only by the scope of the appended claims.

I claim:

1. Apparatus for wet processing fabric with fluid, comprising:

(a) at least one fluid supply source;

(b) a primary container for containing and processing fabric;

(c) means for supplying fluid from at least one fluid supply source to the primary container;

(d) means for supplying fabric to the primary container, including;

(1) main winch for pulling fabric from a bin;
(2) a fabric running control device which, in combination with the main which, feeds the fabric into the primary container;
(3) a quick change venturi system, disposed beneath the main winch and fabric running control device, for receiving fabric from the main winch and fabric running control device, and for receiving fluid from the fluid supplying means;
(4) a plaiting system connected to the quick change venturi system for plaiting the fabric into the chamber; and
(5) an unloading winch for unloading fabric from the primary container;
(e) means for controlling the temperature of the fluids supplied to the primary container;
(f) means for adding agents to the fluid supplied to the primary container;
(g) a plurality of ancillary containers, external to the primary container, for containing fluid;
(h) means for transferring fluid back and forth between the primary container and the ancillary containers; and
(i) means for recirculating fluid through the primary container.

2. Apparatus according to claim 1, wherein the fluid recirculation means includes a primary container inlet and a primary container outlet, a conduit external to the primary container connecting the primary container inlet to the primary container outlet, and means for pumping fluid from within the primary container out of the primary container outlet through the conduit and into the primary container inlet.

3. Apparatus according to claim 2, wherein the fluid supply source includes a flowmeter connected to the conduit for monitoring the volume of fluid supplied to the primary container and a fill valve connected to the conduit between the flowmeter and the primary container.

4. Apparatus according to claim 2, wherein the fluid supply source includes a first fluid supply source of hot water and a second fluid supply source of cold water, and a blend fill valve connected to the conduit and to each fluid supply source to combine fluid from each fluid supply source and to regulate the temperature of the combined fluid.

5. Apparatus according to claim 2, wherein the fluid supply source includes a first fluid supply source of treated water and a second fluid supply source of untreated water, and a blend fill valve connected to the conduit and to each fluid supply source adapted to divert fluid from either the first fluid supply source or the second fluid supply source through the conduit to the primary container.

6. Apparatus according to claim 1, wherein the primary container includes means for partially flooding the primary container.

7. Apparatus according to claim 6, wherein the primary container includes:
(a) a kier for wet processing fabric, which includes means for continuously draining fluid from the kier fluid when the fluid achieves a predetermined level within the kier;
(b) a chamber disposed within the kier, for receiving fabric and fluid therein, the chamber having a plurality of perforations;
(c) wherein the partial flooding means includes a receptacle, having a top opening with a rim thereon, disposed within the kier beneath the chamber, being positioned to collect fluid which passes through the perforations of the chamber, and means for draining fluid from the receptacle.

8. Apparatus according to claim 7, wherein the receptacle is sized to surround the chamber so that the amount of fluid in the chamber is sufficient to permit the flow of fabric through the chamber and the amount of fluid in the kier outside the receptacle is sufficient to meet net pressure suction head requirements of the fluid recirculation means.

9. Apparatus according to claim 1, wherein the temperature controlling means includes: an adjustable nozzle pressure; a lint filter for removing lint from fluid; a heating element for heating fluid which includes a modulating heating valve; and a cooling element for cooling fluid which includes a modulating cooling valve.

10. Apparatus according to claim 1, wherein the agents adding means includes: (a) an additional vessel for containing a mixture of fluid and agents; (b) means for combining fluid with agents in the additional vessel to create a mixture; and (c) means for introducing the mixture into the fluid supplying means, whereby the mixture is transferred to the primary container.

11. Apparatus according to claim 1, wherein each of the ancillary containers is provided with an inlet and inlet valve for regulating the flow of fluid into an ancillary container, a drain port and drain valve for regulating drainage from an ancillary container, and an outlet and outlet valve for redirecting the contents of an ancillary container back into the fluid supplying means.

12. Apparatus according to claim 1, wherein the fluid transferring means includes at least one conduit from the primary container to the ancillary containers, each ancillary container being connected to the conduit, means for pumping fluid from the ancillary containers through the conduit to the primary container and from the primary container to the ancillary containers, and means for regulating the flow of fluid from the ancillary containers to the primary container and from the primary container to the ancillary containers.

13. Method for wet processing fabric with fluid, comprising the steps of:
(a) providing a primary container;
(b) providing a plurality of ancillary containers;
(c) filling each of the ancillary containers with fluid;
(d) transferring the fluid from one of the ancillary containers to the primary container and concurrently circulating fabric within the primary container;
(e) bleaching the fabric in the primary container;
(f) draining the fluid from the primary container;
(g) for each of the remaining ancillary containers,
(1) transferring the fluid from one of the ancillary containers to the primary container;
(2) rinsing or neutralizing the fabric in the primary container;
(3) transferring the fluid from the primary container to one of the ancillary containers which contains no fluid;
(h) filling the primary container with fluid;
(i) rinsing the fabric in the primary container;
(j) transferring the fluid from the primary container to one of the ancillary containers which contains no fluid; and
(k) unloading the fabric from the primary container.

14. Method according to claim 13, wherein the fluid in step (c) is clean water.

15. Method according to claim 13, wherein step (j) includes draining the fluid from the primary container.

16. Method according to claim 13, wherein steps (h), (i) and (j) are repeated at least once.

17. Apparatus for wet processing fabric with fluid, comprising:

(a) at least one fluid supply source;

(b) a primary container for containing and processing fabric, including partial flooding means for partially flooding the primary container;

(c) means for supplying fluid from at least one fluid supply source to the primary container;

(d) means for supplying fabric to the primary container, including;

(1) main winch for pulling fabric from a bin;

(2) a fabric running control device which, in combination with the main winch, feeds the fabric into the primary container;

(3) a quick change venturi system, disposed beneath the main winch and fabric running control device, for receiving fabric from the main winch and fabric running control device, and for receiving fluid from the fluid supplying means;

(4) a plaiting system connected to the quick change venturi system for plaiting the fabric into the chamber; and (5) an unloading winch for unloading fabric from the primary container;

(e) means for controlling the temperature of the fluid supplied to the primary container;

(f) means for adding agents to the fluid supplied to the primary container; and (g) means for recirculating fluid through the primary container.

18. Apparatus according to claim 17, wherein the primary container includes:

(a) a kier for wet processing fabric, which includes means for continuously draining fluid from the kier fluid when the fluid achieves a predetermined level within the kier;

(b) a chamber disposed within the kier, for receiving fabric and fluid therein, the chamber having a plurality of perforations;

(c) wherein the partial flooding means includes a receptacle, having a top opening with a rim thereon, disposed within the kier beneath the chamber, being positioned to collect fluid which passes through the perforations of the chamber, and means for draining fluid from the receptacle.

* * * * *